United States Patent [19]

Okada et al.

[11] Patent Number: 4,537,322

[45] Date of Patent: Aug. 27, 1985

[54] GLASS ENVELOPE FOR A CATHODE-RAY TUBE

[75] Inventors: Hisafumi Okada, Hyogo; Yoshio Suzuki; Shigeo Takenaka, both of Fukaya, all of Japan

[73] Assignee: Tokyo Shibaura Denki Kabushiki Kaisha, Tokyo, Japan

[21] Appl. No.: 560,105

[22] Filed: Dec. 12, 1983

[30] Foreign Application Priority Data

Dec. 13, 1982 [JP] Japan ..... 57-217098
Mar. 9, 1983 [JP] Japan ..... 58-37437

[51] Int. Cl.[3] ..... H01J 61/30

[52] U.S. Cl. ..... 220/2.1 A; 220/2.1 R; 313/477 R; 358/242

[58] Field of Search ..... 220/2.1 R, 2.1 A, 2.3 R, 220/2.3 A; 358/242, 246, 243, 217, 250, 251, 252, 253; 313/477 R

[56] References Cited

U.S. PATENT DOCUMENTS 2,785,821 3/1957 Vermaas et al. ..... 220/2.3 A
2,793,319 5/1957 Nunan ..... 220/2.1 A
3,381,347 5/1968 Reinwall, Jr. ..... 220/2.1 A X
3,519,161 7/1970 Powell et al. ..... 220/2.1 A
3,589,881 6/1971 Langley et al. ..... 220/2.1 A X
3,679,451 7/1972 Marks et al. ..... 220/2.1 A

*Primary Examiner*—Steven M. Pollard
*Attorney, Agent, or Firm*—Cushman, Darby & Cushman

[57] ABSTRACT

A glass envelope for a cathode-ray tube with a glass panel section which has a faceplate of substantially rectangular shape with long and short sides, the faceplate having inner and outer surfaces. Radii of curvature of the inner and outer surfaces are established so that:

$$(Rso - Rsi) > (Rlo - Rli)$$

and $$ti\ (Rso - Rsi) > (Rdo - Rdi),$$

where Rsi, Rli, Rdi and Rso, Rlo, Rdo are inner and outer surface radii, respectively, for the lateral axis, the longitudinal axis and the diagonal axis of the faceplate, respectively.

8 Claims, 9 Drawing Figures

FIG. 1 (PRIOR ART)
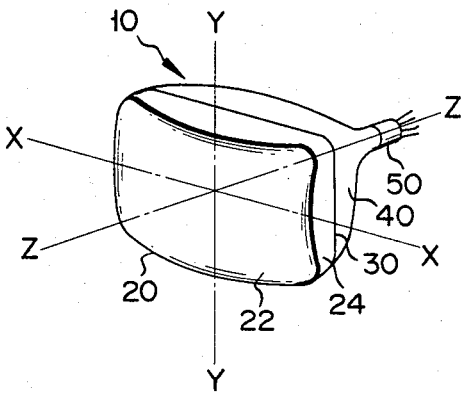
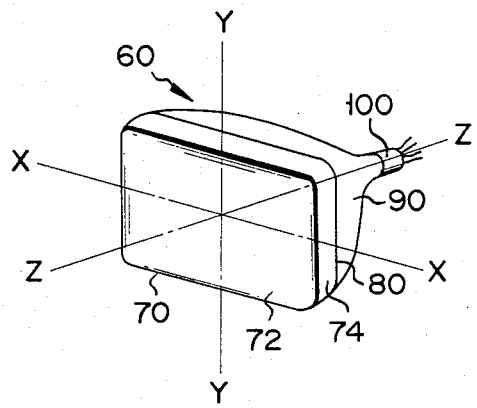
FIG. 3
FIG. 2A (PRIOR ART)
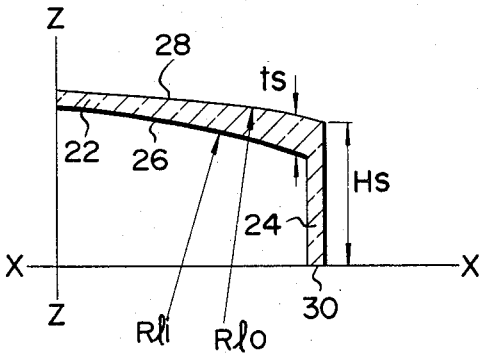
FIG. 2B (PRIOR ART)
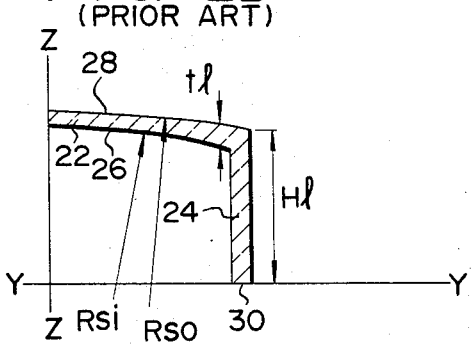
FIG. 2C (PRIOR ART)
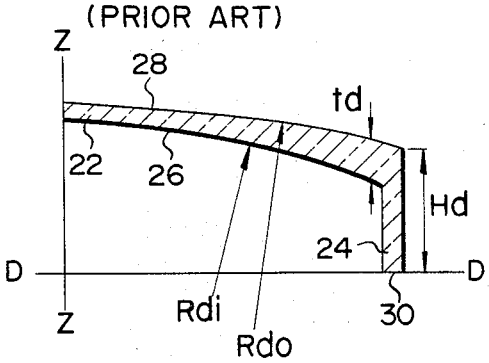

GLASS ENVELOPE FOR A CATHODE-RAY TUBE

BACKGROUND OF THE INVENTION

The present invention relates to a cathode-ray tube in general and, in particular, to the structure of a glass panel section of a cathode-ray tube.

In a conventional cathode-ray tube, (as shown in an exemplary embodiment by 10 in FIG. 1) a phosphor screen is formed on the inner surface of a substantially rectangular shaped faceplate 22 of a glass panel section 20. A funnel section 40 having a deflection yoke device (not shown) therearound is sealed to a skirt 24 of the glass panel section 20 through a connective portion 30. A neck 50 extends from the funnel section 40, and an electron gun (not shown) for emitting an electron beam or electron beams is disposed within the neck 50. The envelope of the conventional cathode-ray tube 10 is comprised of the glass panel section 20, the funnel section 40 and the neck 50. The interior of the envelope is evacuated to a high vacuum (i.e., low pressure).

In the conventional cathode-ray tube of the type described above, the electron beam from the electron gun is deflected in accordance with, for example, the NTSC system. In a color cathode-ray tube, the electron beams are projected on the phosphor screen through a plurality of apertures of a shadow mask opposing the inner surface of the faceplate 22. To decrease difference between the length of an electron beam path from the electron gun to a peripheral portion of the phosphor screen (i.e., the peripheral region of the inner surface of the faceplate 22) and an electron beam path from the electron gun to the central region of the phosphor screen (i.e., the central region of the inner surface of the faceplate 22), and between deflection of the electron beam from the electron gun to the peripheral region of the phosphor screen and deflection of the electron beam from the electron gun to the central region thereof, the inner and outer surfaces of the conventional rectangular faceplate 22 are curved outward with given radii of curvature. For example, as shown in FIGS. 2A to 2C, a longitudinal axis (X—X) shown in FIG. 1 is normal to the tube axis and parallel to a line passing through center points of short sides of the the faceplate 22, a lateral axis (Y—Y) shown in FIG. 1 is normal to the tube axis and parallel to a line passing through center points of the long sides of the faceplate 22 and a diagonal axis (D—D) shown in FIG. 1 is normal to the tube axis and parallel to a line passing through the diagonal coners of the faceplate 22. If the inner surface radii of curvature along the lateral axis (Y—Y), the longitudinal axis (X—X) and the diagonal axis (D—D) of an inner surface 26 of the faceplate 22 are represented by Rsi, Rli and Rdi, respectively, and the outer surface radii of curvature along the lateral, longitudinal and diagonal axes of the outer surface thereof are Rso, Rlo and Rdo, respectively, the conventional faceplate 22 is generally designed and manufactured in a manner such that $Rsi=Rli=Rdi=Ri$ and $Rso=Rlo=Rdo=Ro$, wherein Ri and Ro are predetermined values.

As shown in FIGS. 2A to 2C, when Hs, Hl and Hd denote respectively the various lengths of the skirt 24 at different portions thereof including the center portion of the short side, the center portion of the long side and the corner along the tube axis, respectively, the lengths of skirt 24 satisfy the inequality $Hl>Hs>Hd$ whenever the outer surface radii of curvature are established in accordance with the foregoing relations. As is also apparent from FIGS. 2A to 2C, when ts, tl and td represent thicknesses of the faceplate 22 in the vicinity of the center portion of the short side, the center portion of the long side and the corner thereof, respectively, the thicknesses satisfy the inequality $tl<ts<td$ in accordance with the relationships of distances between the tube axis and the center portion of the long side, between the tube axis and the center portion of the short side and between the tube axis and the corner, when the values Ri and Ro of the inner and outer surfaces radii of curvature are given as predetermined values, respectively, and the value Ri of the inner surface radii of curvature is equal to or smaller than the value Ro of the outer surface radii of curvature. In particular, in a large tube having a large distance between the tube axis and the peripheral portion of the faceplate 22, the difference between the thickness td (at the corner) and the thickness tl (at the center portion of the long side) or the difference between the thickness td (at the corner) and the thickness ts (at the center portion of the short side) is increased when screen size is increased.

In the glass panel section 20 of this type, any stress is focused to act on mechanically weak portions of the cathode-ray tube, and implosion tends to occur due to this stress. One of the mechanically weak portions is the connective portion 30 between the glass panel section 20 and the funnel section 40. In general accidental impact to the outer surface 28 of the faceplate 22 is transmitted to the connective portion 30 through skirt 24. Impact acting on the corner where the length of the skirt 24 is shortest remains substantially undamped, and such impact is therefore directly applied to the connective portion 30. An envelope having such a conventional glass panel section tends to be vulnerable to implosion. Other mechanically weak portions include the center portion of the long side, at which the difference between the inner pressure of the envelope and atmospheric pressure exists. Since the thicknesses satisfy the inequality $tl<ts<td$, the thickness tl at the center portion of the long side is smaller than that at any other peripheral portion, and this portion is accordingly vulnerable to implosion.

SUMMARY OF THE INVENTION

It is an object of the present invention to provide a cathode-ray tube having a glass panel section which has a high mechanical strength and a thin faceplate, and which is is light weight.

According to the present invention, there is provided a cathode-ray tube comprising a glass panel section which constitutes a glass envelope having a tube axis, and said glass panel section includes a faceplate and a skirt, said faceplate having a substantially rectangular shape and having curved inner and outer surfaces, and said skirt extending from a peripheral portion of said faceplate along the tube axis.

Said inner surface is defined by a first inner surface radius of curvature Rsi set within a first plane including the tube axis and passing through center points of long sides of the said faceplate, a second inner surface radius of curvature Rli set within a second plane including the tube axis and passing through center points of short sides of said faceplate, and a third inner surface radius of curvature Rdi set within a third plane including the tube axis and a diagonal line connecting a pair of diagonally opposing corners of said faceplate.

Said outer surface is defined by a first outer surface radius of curvature Rso set within said first plane, a second outer surface radius of curvature Rlo set within said second plane, and a third outer surface radius of curvature Rdo set within said third plane.

The inner and outer surface radii of curvature are defined in accordance with the present invention by the following inequalities (1) and (2), respectively:

$$Rsi < Rli \text{ and } Rsi < Rdi \quad (1),$$

$$Rso < Rlo \text{ and } Rso < Rdo \quad (2).$$

BRIEF DESCRIPTION OF THE DRAWINGS

FIG. 1 is a schematic perspective view of an envelope of a conventional cathode-ray tube;

FIGS. 2A to 2C are respectively schematic partial sectional views of the glass panel section taken along the longitudinal axis (X—X), the lateral axis (Y—Y) and the diagonal axis (D—D) in prior art FIG. 1;

FIG. 3 is a schematic perspective view of an envelope of a cathode-ray tube according to an exemplary embodiment of the present invention;

DETAILED DESCRIPTION OF THE PREFERRED EMBODIMENT

Figure 4A:
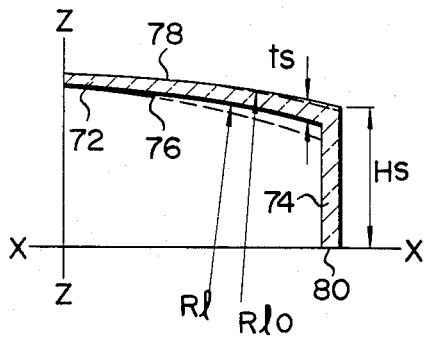
FIGS. 4A to 4C are respectively schematic partial sectional views of the glass panel section taken along the longitudinal axis (X—X), the lateral axis (Y—Y) and the diagonal axis (D—D) in FIG. 3.

FIG. 3 shows a cathode-ray tube 60 according to an embodiment of the present invention. In this cathode-ray tube 60, a funnel section 90 is hermetically sealed onto a skirt 74 of a glass panel section 70 (to be described in detail later) through a connective portion 80, thereby forming an envelope. The envelope is evacuated to a high vacuum (i.e., low pressure). An electron gun for emitting an electron beam(s) is disposed in a neck 100 extending from the funnel section 90 along a tube axis (Z—Z). A deflection yoke device (not shown) for deflecting the electron beam is provided on the outer periphery of the funnel section 90. A phosphor screen (not shown) is formed on the inner surface of a faceplate 72 of the glass panel section 70 such that the phosphor screen emits light when the electron beam is projected onto it. Furthermore, in the case of a color cathode-ray tube, a shadow mask (not shown) is disposed opposite the phosphor screen so as to pass the electron beams through a large number of apertures thereof.

In the glass panel section 70 of the cathode-ray tube of the present invention (as shown in FIGS. 3 and 4A to 4C) the faceplate 72 having a front face of a substantially rectangular shape has respectively flat inner and outer surfaces, as compared with the faceplate 22 of the conventional cathode-ray tube 10. This is apparent from the partial sectional views of the faceplate 72 in FIGS. 4A to 4C as compared with those of the faceplate 22 in FIGS. 2A to 2C. For comparative purposes, the profiles from FIGS. 2A-2C of the conventional faceplate 22 are illustrated by dotted lines in FIGS. 4A to 4C. Herein, a longitudinal axis (X—X) shown in FIG. 3 is normal to the tube axis and parallel to a line passing through center points of the short sides of the faceplate 72, a lateral axis (Y—Y) shown in FIG. 3 is normal to the tube axis and parallel to a line passing through center points of the long sides of the faceplate 72, and a diagonal axis (D—D) shown in FIG. 3 is normal to the tube axis and parallel to a line passing through a pair of diagonally opposite corners of the faceplate 72.

The preferred shape of the glass panel section 70 as disclosed is particularly successful in preventing implosion. Based on the teaching that the thickness of the faceplate 72 of the glass panel section 70 and the length of the skirt 74 of the glass panel section 70 are significant factors in preventing implosion, the present exemplary embodiment incorporates appropriate radii of curvature of inner and outer surfaces 76 and 78 respectively, to reduce the risk of implosion.

Figure 4B:
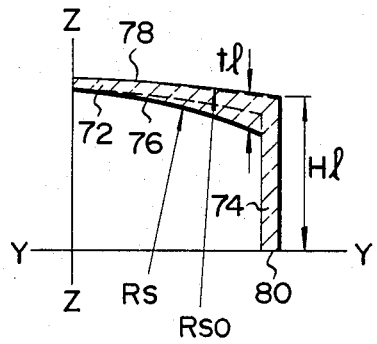
Figure 4C:
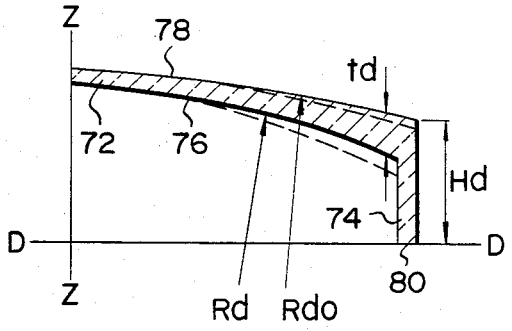

The length of the skirt 74 is to be considered in determining the outer surface radii of curvature of the outer surface 78. As shown in FIGS. 4A to 4C, when Hs, Hl and Hd respectively denote the length of the skirt 74 at the center point of the short side, the center point of the long side and the corner along the tube axis between the outer surface 78 and the connective portion 80, they must be as large as possible to protect the mechanically weak connective portion 80 against any impact may be uniformly distributed (even if the stress acts on the connective portion 80) if relationships are established as follows:

$$Hs \simeq Hl \simeq Hd \quad (1).$$

The symbol "≃" means "substantially or relatively equal to". When the outer surface radii of curvature of the outer surface 78 along the lateral axis (Y—Y), the longitudinal axis (X—X) and the diagonal axis (D—D) are represented by Rso, Rlo and Rdo, respectively, they must satisfy the following inequality (2) in order to satisfy the inequality (1):

$$Rso < Rlo < Rdo \quad (2).$$

However, in a large cathode-ray tube where the difference between the length of a pair of diagonally opposite corners (the length of a diagonal line) and the length of the short side, or the difference between the length of the long side and the length of the short side of a faceplate, is increased, it is very difficult to satisfy the above relationship (1). Therefore, the length of the skirt 74 of such a large cathode-ray tube may be set as follows by virtue of its mechanical expansion stress caused by the atmospheric pressure:

$$Hl \quad Hs \quad Hd \quad (3).$$

In order to satisfy this inequality (3), the relationships among the outer surface radii of curvature of the outer surface 78 along the lateral axis (Y—Y), the longitudinal axis (X—X) and the diagonal axis (D—D) must be established as follows:

$$Rso < Rlo \text{ and } Rso < Rdo \quad (4).$$

In a glass panel section 70 of a cathode-ray tube 60 satisfying the relationships presented in inequality (4) (and especially in a large-sized cathode-ray tube) the outer surface radius of curvature Rso along lateral axis (Y—Y) of the outer surface 78 can be minimized, so that the stress acting on the long side wall of the faceplate 72 can be damped. In this fashion, the well-distributed stress can act on the side walls of the glass panel section 70 and on a metal tension band (or similar band) wound around the side walls of the glass panel section 70 (i.e., the outer surface of the skirt 74). By comparison with the conventional glass panel section, resistance to implosion is increased by a factor of 1.5 to 2.0. Furthermore, the peripheral portion of the glass panel section 70 is at substantially the same length as the central portion thereof, so that the outer surface 78 of the faceplate 72 is made flatter. Therefore, the outer surface radius of curvature Rlo of the outer surface 78 along the longitudinal axis (X—X) is preferably equal to the outer surface radius of curvature Rdo along the diagonal axis (D—D). In other words, the relationship Rlo≃Rdo is a preferred additional term of inequality (4).

Figure 5:
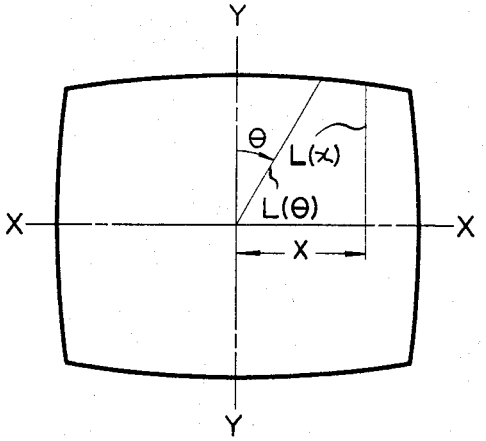
FIG. 5 is a front view showing the outer surface of the faceplate of the glass panel when viewed from the front of the cathode-ray tube shown in FIG. 3.

In the above description concerning the outer surface radii of curvature of the outer surface 78 of the faceplate 72, the outer surface radii of curvature Rso, Rlo and Rdo are given as radii of curvature of a simple curve, respectively. However, they can be given as radii of curvature of a compound curve, respectively, such that each compound radius of curvature includes a plurality of radii of curvature changing from the center to the peripheral portion of the faceplate 72. The compound radii of curvature can be given by a a polynomial relationship which may be developed in accordance with the present invention. The outer surface radii of curvature Rso, Rlo and Rdo of the outer surface 78 of the faceplate 72 differ along the lateral axis (Y—Y), longitudinal axis (X—X) and the diagonal axis (D—D), respectively. These different radii of curvature are determined by average approximation values obtained by developing a polynomial such that resultant curves are smoothly continuously connected. For example, as shown in FIG. 5, a radius of curvature $R(\theta)$ of a line $L(\theta)$ which is rotated in a clockwise direction, as shown in FIG. 5 is given by equation (5):

$$R(\theta)=R_0+R_1\cos 2\theta+R_2\cos 4\theta \quad (5).$$

where $R_0$, $R_1$ and $R_2$ are constants which can be arbitrarily selected and an angle $\theta$ is defined between the lateral axis (Y—Y) and the line $L(\theta)$. As shown in FIG. 5, a radius of curvature R(X) of a line L(X) which is spaced a distance X from the center of the faceplate 22 along the longitudinal axis (X—X), and is parallel to the lateral axis (Y—Y), is given by equation (6):

$$R(X) = Rso - (Rlo - \sqrt{(Rlo)^2 - (X)^2}\ ). \quad (6)$$

A glass panel section 70 which satisfies inequality (4) and has conditions as represented by equations (5) and (6) has a high mechanical strength as compared to the conventional glass panel section 20. Furthermore, when the radii of curvature of the inner surface 76 of the face plate 72 are determined (as discussed below), the weight of the glass panel section can be decreased.

The thickness of the faceplate 72 is considered in determining the inner surface radii of curvature of the inner surface as follows. Compound radii of curvature can be used in the same manner as for the outer surface radii of curvature. However, for simplicity of manufacture, simple radii of curvature are used for those of the inner surface.

As shown in FIGS. 4A to 4C, when ts, tl and td respectively denote thickness of the faceplate 72 in the vicinity of the center portion of the short side, the center portion of the long side, and the corner, they must satisfy the following relationship to ensure high mechanical strength:

$$tl > ts > td \quad (7).$$

When the inner surface radii of curvature of the inner surface 76 of the faceplate 72 along the lateral axis (Y—Y), the longitudinal axis (X—X) and the diagonal axis (D—D) are represented by Rsi, Rlo and Rdi, respectively, they are restricted to values which satisfy the following inequalities so as to satisfy inequality (7) in the same manner as the radii of curvature of the outer surface 78:

$$Rsi < Rli \text{ and } Rsi < Rdi \quad (8).$$

The inner surface radii of curvature Rsi, Rli and Rdi of the inner surface 76 of the faceplate 72 which are given by the inequalities in (8) can be set independently of the outer surface radii Rso, Rlo and Rdo of the outer surface 78 thereof. However, if the inner surface radii of curvature of the inner surface 76 of the faceplate 72 are set to be smaller than those of the outer surface thereof, the radii of curvature of the inner and outer surfaces 76 and 78 must satisfy the following inequalities:

$$(Rso-Rsi) > (Rlo-Rli) \text{ and } (Rso-Rsi) > (Rdo-Rdi) \quad (9).$$

In any glass panel section 70 of a cathode-ray tube 60 which satisfies inequalities (8) or (9), the thickness tl at the center portion of the long side is increased to effectively reinforce the mechanical strength. The overall weight of the glass panel section 70 can be reduced when the radii of curvature of the inner and outer surfaces 76 and 78 are set properly. In particular, in the case of a color cathode-ray tube, the radius of curvature of the shadow mask along the lateral axis corresponding to the inner surface radius of curvature of the inner surface 76 of the faceplate 72 can be decreased as compared with that of the conventional faceplate. The shadow mask can then have high mechanical strength against deformation stresses, including external mechanical vibration and thermal expansion of the shadow mask itself. The radius of curvature of the shadow mask along the lateral axis is shorter than that along of the longitudinal axis, so that color degradation called "doming" can be improved by changing an aperture pitch along the lateral axis of the shadow mask.

An example is described with reference to practical values wherein the present invention is applied to a 26-inch cathode-ray tube.

As a first example, conditions Rso=Rlo=Rdo=Ro=1090 mm, Rsi=910 mm, Rli=990 mm and Rdi=1033 mm are established. Also, the thickness at the center of the faceplate 72 is 12.0 mm. The thickness of the faceplate 72 in the vicinity of the center portion of the long side, the center portion of the short side and the corner are 15.7 mm (=tl), 15.4 mm (=ts) and 14.7 mm (=td), respectively. As a result, the thickness at the center portion of the long side "(which has the mechanically weakest portion) is increased, thereby obtaining a cathode-ray tube with a glass panel section which prevents implosion in accordance with the features of the present invention, so that the mechanical strength of the cathode-ray tube as a whole is increased.

As a second example, conditions Rsi=950 mm, Rli=990 mm, Rdi=1020 mm, Rso=990 mm, Rlo=1010 and Rdo=1033 mm are established. Also, the thickness at the center portion of the faceplate 72 is 12.0 mm. The thickness of the faceplate 72 in the vicinity of the center portion of the long side, the center portion of the short side and the corner are 12.86 mm (=tl), 12.74 mm (=ts) and 12.65 mm (=td), respectively. This glass panel section has the same strength as that of the first example. Furthermore, this second glass panel section is much lighter than that of the first example.

The foregoing presently preferred embodiments are exemplary only, and do not preclude inclusion of such modifications and variations to the present invention which would be readily apparent or obvious to one of ordinary skill in the art, the scope of the present invention being set forth in the following appended claims.

What is claimed is:

1. A glass envelope for a cathode-ray tube having a tube axis comprising:

a glass panel section including a faceplate and a skirt, said faceplate having two face surfaces on opposite sides of said faceplate, a substantially rectangular shape with long and short sides, a curved inner surface on one face surface thereof and a curved outer surface on the other face surface thereof, and said skirt extending from a peripheral portion of said faceplate along the tube axis, said inner surface including a first inner surface radius of curvature Rsi set within a first plane including the tube axis and passing through center points of long sides of said faceplate, a second inner surface radius of curvature Rli set within a second plane including the tube axis and passing through center points of short sides of said faceplates and a third inner surface radius of curvature Rdi set within a third plane including the tube axis and a diagonal line connecting a pair of diagonally opposite corners of said faceplate, said outer surface including a first outer surface radius of curvature Rso set within said first plane, a second outer surface radius of curvature Rlo set within said second plane and a third outer surface radius of curvature Rdo set within said third plane, and said inner and outer surface radii of curvature being defined by the following inequalities (1) and (2), respectively:

$$Rsi < Rli \text{ and } Rsi < Rdi \quad (1),$$

$$Rso < Rlo \text{ and } Rso < Rdo \quad (2).$$

2. A glass envelope according to claim 1, wherein said inner and outer surface radii of curvature Rsi, Rli and Rdi and Rso, Rlo and Rdo respectively form one of a simple curve and a compound curve.

3. A glass envelope according to claim 2, wherein said outer surface radii of curvature Rso, Rlo and Rdo are no shorter than said inner surface radii of curvature Rsi, Rli, and Rdi, respectively.

4. A glass envelope according to claim 3, wherein said inner and outer surface radii of curvature are in accordance with the following interrelationships:

$$(Rso-Rsi)>(Rlo-Rli) \text{ and}$$

$$(Rso-Rsi)>(Rdo-Rdi).$$

5. A glass envelope according to claim 4, wherein length Hs, length Hl and length Hd, which respectively represent the length of said skirt at a center point of a short side thereof, at a center point of a long side thereof and at a corner thereof, when measured between the outer surface and an end portion of the skirt along said tube axis, satisfy the relationship:

$$Hl \simeq Hs \simeq Hd.$$

6. A glass envelope according to claim 4, wherein length Hs, length Hl and length Hd, which respectively represent the length of said skirt at a center point of a short side thereof, at a center point of a long side thereof and at a corner thereof, when measured between the outer surface and an end portion of the skirt along said tube axis, satisfy the relationship:

H Hs Hd.

7. A glass envelope according to claim 6, wherein a radius of curvature R ($\theta$) for an angle ($\theta$) through which a line passing through center points of short sides of one of the inner and outer surfaces rotated in a direction perpendicular to the tube axis is defined by:

$$R(\theta)=R_0+R_1 \cos 2\theta+R_2 \cos 4\theta.$$

where $R_0$, $R_1$ and $R_2$ are constants.

8. A glass envelope according to claim 7, wherein radii or curvature Ro(X) and Ri(X) each set within a plane which is parallel to said first plane including the tube axis and passing through center points of said long sides and spaced apart by a distance X along a direction parallel to a line passing through said center points of said short sides of said one of the inner and outer surfaces are respectively defined:

$$Ro(X) = Rso - (Ri - \sqrt{(Rlo)^2 - (X)^2}) \text{ and}$$

$$Ri(X) = Rsi - (Rsi - \sqrt{(Rli)^2 - (X)^2}).$$

* * * * *

UNITED STATES PATENT AND TRADEMARK OFFICE

CERTIFICATE OF CORRECTION

PATENT NO. : 4,537,322

DATED : August 27, 1985

INVENTOR(S) : OKADA et al

It is certified that error appears in the above-identified patent and that said Letters Patent is hereby corrected as shown below:

Title page:

The assignee should be shown as: TOKYO SHIBAURA DENKI KABUSHIKI KAISHA, KAWASAKI, Japan.

Signed and Sealed this

*Twenty-fifth* Day of *February 1986*

[SEAL]

*Attest:*

DONALD J. QUIGG

*Attesting Officer*

*Commissioner of Patents and Trademarks*

US004537322B1

REEXAMINATION CERTIFICATE (3456th)

United States Patent [19] [11] B1 4,537,322

Okada et al. [45] Certificate Issued Mar. 10, 1998

[54] GLASS ENVELOPE FOR A CATHODE-RAY TUBE

[75] Inventors: Hisafumi Okada, Hyogo; Yoshio Suzuki; Shigeo Takenaka, both of Fukaya, all of Japan

[73] Assignee: Tokyo Shibaura Denki Kabushiki Kaisha, Kawasaki, Japan

Reexamination Request:
No. 90/004,182, Mar. 13, 1996

Reexamination Certificate for:

| | |
|---|---|
| Patent No.: | **4,537,322** |
| Issued: | **Aug. 27, 1985** |
| Appl. No.: | **560,105** |
| Filed: | **Dec. 12, 1983** |

Certificate of Correction issued Feb. 25, 1986.

[30] Foreign Application Priority Data

| | | | |
|---|---|---|---|
| Dec. 13, 1982 | [JP] | Japan | 57-217098 |
| Mar. 9, 1983 | [JP] | Japan | 58-37437 |

[51] Int. Cl.[6] ..... H01J 61/30

[52] U.S. Cl. ..... 220/2.1 A; 220/2.1 R; 313/477 R

[58] Field of Search ..... 220/2.1 R, 2.1 A; 313/477 R

[56] References Cited

U.S. PATENT DOCUMENTS

| | | | |
|---|---|---|---|
| 2,785,821 | 3/1957 | Vermaas et al. | 220/2.3 A |
| 2,793,319 | 5/1957 | Nunan | 220/2.1 A |
| 3,381,347 | 5/1968 | Reinwall, Jr. | 220/2.1 A X |
| 3,519,161 | 7/1970 | Powell et al. | 220/2.1 A |
| 3,589,881 | 6/1971 | Langley et al. | 220/2.1 A X |
| 3,679,451 | 7/1972 | Marks et al. | 220/2.1 A |
| 3,931,906 | 1/1976 | Bradu . | |
| 4,839,556 | 6/1989 | Ragland, Jr. . | |

FOREIGN PATENT DOCUMENTS

| | | |
|---|---|---|
| 54-35754 | 11/1974 | Japan . |
| 52-144654 | 8/1977 | Japan . |
| 52-137764 | 10/1977 | Japan . |
| 54-97360 | 8/1979 | Japan . |
| 55-28270 | 2/1980 | Japan . |
| 57-103239 | 6/1982 | Japan . |
| 58-16444 | 1/1983 | Japan . |

*Primary Examiner*—Steven M. Pollard

[57] ABSTRACT

A glass envelope for a cathode-ray tube with a glass panel section which has a faceplate of substantially rectangular shape with long and short sides, the faceplate having inner and outer surfaces. Radii of curvature of the inner and outer surfaces are established so that:

$$(Rso-Rsi)>(Rlo-Rli)$$

and $$(Rso-Rsi)>(Rdo-Rdi),$$

where Rsi, Rli, Rdi and Rso, Rlo, Rdo are inner and outer surface radii, respectively, for the lateral axis, the longitudinal axis and the diagonal axis of the faceplate, respectively.

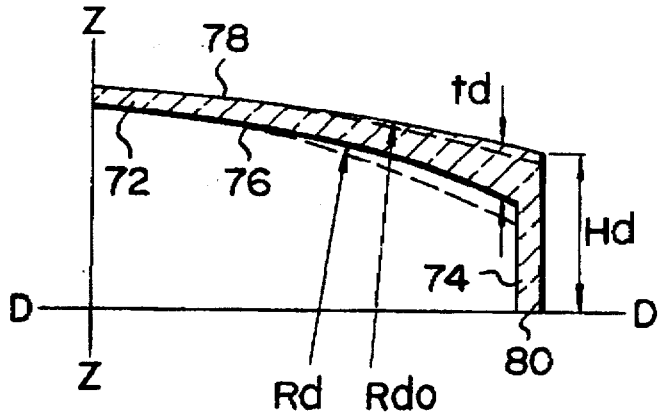

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, lines 40–51:

However, in a large cathode-ray tube where the difference between the length of a pair of diagonally opposite corners (the length of a diagonal line) and the length of the short side, or the difference between the length of the long side and the length of the short side of a face-plate, is increased, it is very difficult to satisfy the above relationship (1). Therefore, the length of the skirt 74 of such a large cathode-ray tube may be set as follows by virtue of its mechanical expansion stress caused by the atmospheric pressure:

$$[Hl\ Hs\ Hd]\ Hl \geqq Hs \geqq Hd \quad (3).$$

AS A RESULT OF REEXAMINATION, IT HAS BEEN DETERMINED THAT:

Claims 4 and 6 are cancelled.

Claims 1, 2, 5, and 7 are determined to be patentable as amended.

Claims 3 and 8, dependent on an amended claim, are determined to be patentable.

New claim 9 is added and determined to be patentable.

1. A glass envelope for a cathode-ray tube having a tube axis comprising:

a glass panel section including a faceplate and a skirt, said faceplate having two face surfaces on opposite sides of said faceplate, a substantially rectangular shape with long and short sides, a curved inner surface on one face surface thereof and a curved outer surface on the other face surface thereof, and said skirt extending from a peripheral portion of said faceplate along the tube axis, said inner surface including a first inner surface radius of curvature Rsi set within a first plane including the tube axis and passing through center points of long sides of said faceplate, a second inner surface radius of curvature Rli set within a second plane including the tube axis and passing through center points of short sides of said faceplates and a third inner surface radius of curvature Rdi set within a third plane including the tube axis and a diagonal line connecting a pair of diagonally opposite corners of said faceplate, said outer surface including a first outer surface radius of curvature Rso set within said first plane, a second outer surface radius of curvature Rlo set within said second plane and a third outer surface radius of curvature Rdo set within said third plane, [and]

said inner and outer surface radii of curvature being defined by the following inequalities (1) and (2), respectively:

$$Rsi<Rli \text{ and } Rsi<Rdi \quad (1),$$

$$Rso<Rlo \text{ and } Rso<Rdo \quad (2),$$

*wherein at least one of said radii of curvature Rsi, Rli, Rdi, Rso, Rlo or Rdo form a compound curve,*

*and wherein said inner and outer surface radii of curvature are in accordance with the following relationships:*

$$(Rso-Rsi)>(Rlo-Rli) \text{ and}$$

$$(Rso-Rsi)>(Rdo-Rdi)\text{: and}$$

*wherein length Hs, length Hl and length Hd, which respectively represent the length of said skirt at a center point of a short side thereof, at a center point of a long side thereof and at a corner thereof, when measured between the outer surface and an end portion of the skirt along said tube axis, satisfy the relationship:*

$$Hl \geqq Hs \geqq Hd.$$

2. A glass envelope according to claim 1, wherein *each of* said inner and outer surface radii of curvature Rsi, Rli, and Rdi, and Rso, Rlo, and Rdo [respectively] form [one of a simple curve and] a compound curve.

5. A glass envelope according to claim [4] *3*, wherein length Hs, length Hl and length Hd, which respectively represent the length of said skirt at a center point of a short side thereof, at a center point of a long side thereof and at a corner thereof, when measured between the outer surface and an end portion of the skirt along said tube axis, satisfy the relationship:

$$Hl=Hs=Hd.$$

7. A glass envelope according to claim [6] *3*, wherein a radius of curvature R (θ) for an angle (θ) through which a line passing through center points of short sides of one of the inner and outer surfaces rotated in a direction perpendicular to the tube axis is defined by:

$$R(\theta)=R_0+R_1\cos 2\theta+R_2\cos 4\theta,$$

where $R_0$, $R_1$ and $R_2$ are constants.

*9. A glass envelope according to claim 1, wherein said outer surface radii of curvature Rso, Rlo and Rdo are no shorter than said inner surface radii of curvature Rsi, Rli, and Rdi, respectively.*

* * * * *